US007113141B2

(12) United States Patent
Almog et al.

(10) Patent No.: US 7,113,141 B2
(45) Date of Patent: Sep. 26, 2006

(54) FRACTAL DIPOLE ANTENNA

(75) Inventors: Benyamin Almog, Beit Arie (IL); Laurent Habib, Moshav Shapira (IL)

(73) Assignee: Elta Systems Ltd., Ashdod (IL)

( * ) Notice: Subject to any disclaimer, the term of this patent is extended or adjusted under 35 U.S.C. 154(b) by 16 days.

(21) Appl. No.: 11/046,891

(22) Filed: Feb. 1, 2005

(65) Prior Publication Data

US 2006/0170604 A1 Aug. 3, 2006

(51) Int. Cl.
*H01Q 9/28* (2006.01)

(52) U.S. Cl. ..... 343/795; 343/821

(58) Field of Classification Search ..... 343/795, 343/820, 821, 793
See application file for complete search history.

(56) References Cited

U.S. PATENT DOCUMENTS 6,104,349 A * 8/2000 Cohen ..... 343/702
6,127,977 A 10/2000 Cohen
6,140,975 A * 10/2000 Cohen ..... 343/846
6,300,914 B1 10/2001 Yang
6,452,553 B1 9/2002 Cohen
6,476,766 B1 * 11/2002 Cohen ..... 343/700 MS
6,525,691 B1 2/2003 Varadan et al.
7,019,695 B1 * 3/2006 Cohen ..... 343/700 MS

FOREIGN PATENT DOCUMENTS

WO 02/01668 A2 1/2002
WO 03/034538 A1 4/2003

OTHER PUBLICATIONS

Puete-Baliarada, C., et al., "On the Behavior of the Sierpinski Multiband Fractal Antenna", *IEEE Transactions on Antennas and Propagation*, vol. 46, No. 4, pp. 517-524, (1998).
Soler, J., et al., "Novel Combined Multiband Antenna Elements Inspired on Fractal Geometries", *27th ESA Antenna Workshop on Innovative Periodic Antennas: Electromagnetic Bandgap, Left-handed Materials, Fractal and Frequency Selective Surfaces*, pp. 245-251 (2004).
XP006017045: Song, C. T. P., et al., "Shorted Fractal Sierpinski Monopole Antenna", *Electronic Letters, IEE Stevenage*, GB, vol. 37, No. 16, pp. 1000-1001, (Aug. 2, 2001).

* cited by examiner

*Primary Examiner*—Hoang V. Nguyen
(74) *Attorney, Agent, or Firm*—Nath & Associates PLLC; Gregory B. Kang; Stanley N. Protigal

(57) ABSTRACT

A dipole fractal antenna and a method of manufacturing thereof are described. The antenna includes a pair of oppositely directed radiating arms coupled to a feeding terminal and extended therefrom along a central axis in a common plane. At least a portion of each radiating arm has a fractal geometric shape. The antenna also includes at least one pair of electrical shunts configured for connecting at least two points selected within the fractal portion of one radiating arm correspondingly to two points selected within the fractal portion of another radiating arm. The dipole fractal antenna further may comprise a balun arranged at the feeding terminal and configured for coupling the pair of oppositely directed radiating arms to a coaxial cable to provide a balanced feed.

25 Claims, 10 Drawing Sheets

FRACTAL DIPOLE ANTENNA

FIELD OF THE INVENTION

The present invention relates generally to antennas, and in particular, to fractal antennas.

BACKGROUND OF THE INVENTION

There are many applications in which the small size of the antennas is a desirable feature due to cosmetic, security, aerodynamic and other reasons. There are also applications in which surface conformability of the antennas or a possibility to mount an antenna on a platform, which is not flat or planar, is a desirable feature.

For example, in mobile devices (e.g., cellular phones, PDAs, laptops, etc), reducing antenna's size is required since the amount of space available for mounting an antenna is limited. For antennas mounted on airplanes, the protrusion of the antenna beyond the surface of the plane should be minimized in order to reduce the effect of the antenna on its aerodynamic properties.

Fractal antennas are known in the art as solutions to significantly reduce the antenna size, e.g., from two to four times, without degenerating the performance. Moreover, applying fractal concept to antennas can be used to achieve multiple frequency bands and increase bandwidth of each single band due to the self-similarity of the geometry. Polarization and phasing of fractal antennas also are possible.

The self-similarity of the antenna's geometry can be achieved by shaping in a fractal fashion, either through bending or shaping a surface and/or a volume, or introducing slots and/or holes. Typical fractal antennas are based on fractal shapes such as the Sierpinski gasket, Sierpinski carpet, Minkovski patches, Mandelbrot tree, Koch curve, Koch island, etc (see, for example, U.S. Pat. Nos. 6,127,977 and 6,452,553 to N. Cohen).

Referring to FIGS. 1A to 1D, several examples of typical fractal antennas are illustrated.

In particular, the Triadic Koch curve has been used to construct a monopole and a dipole (see FIGS. 1A and 1B) in order to reduce antenna size. For example, the length of the Koch dipole antenna is reduced by a factor of 1.9, when compared to the arm length of the regular half-wave dipole operating at the same frequency. The radiation pattern of a Koch dipole is slightly different from that of a regular dipole because its fractal dimension is greater than 1.

An example of a fractal tree structure explored as antenna element is shown in FIG. 1C. It was found that the fractal tree usually can achieve multiple wideband performance and reduce antenna size.

FIG. 1D shows an example of a Sierpinski monopole based on the Sierpinski gasket fractal shape. The original Sierpinski gasket is constructed by subtracting a central inverted triangle from a main triangle shape. After the subtraction, three equal triangles remain on the structure, each one being half of the size of the original one. Such subtraction procedure is iterated on the remaining triangles. In this particular case, the gasket has been constructed through five iterations, so five-scaled version of the Sierpinski gasket can be found on the antenna (circled regions in FIG. 1), the smallest one being a single triangle.

The behavior of various monopole antennas based on the Sierpinski gasket fractal shape is described in U.S. Pat. No. 6,525,691 to Varadan et al., in a paper titled "*On the Behavior of the Sierpinski Multiband Fractal Antenna*," by C. Puente-Baliarda, et al., IEEE Transact. Of Antennas Propagation, 1998, V. 46, No. 4, PP. 517–524; and in a paper titled "*Novel Combined Multiband Antenna Elements Inspired on Fractal Geometries*," by J. Soler, et al., 27$^{th}$ ESA Antenna Workshop on Innovative Periodic Antennas: Electromagnetic Bandgap, Left-handed Materials, Fractals and Frequency Selective Surfaces, 9–11 Mar. 2004 Santiago de Compestele, Spain, PP.245–251. It is illustrated in these publications that the geometrical self-similarity properties of the fractal structure are translated into its electromagnetic behavior. It was shown that the antenna is matched approximately at frequencies $$f_n \approx 0.26\frac{c}{h}\delta^n,$$

where c is the speed of light in vacuum, h is the height of the largest gasket, δ=2, and n a natural number. In particular, the lowest frequency of operation in such antennas is determined by the height of the largest gasket.

Various fractal loop antennas are also known in the art. For example, U.S. Pat. No. 6,300,914 describes a wideband antenna that operates at multiple frequency bands. The antenna is formed from a plurality of fractal elements either cascade connected, series connected or parallel connected. Each of the fractal elements are folded in a same plane of the fractal element to form a sawtooth pattern.

SUMMARY OF THE INVENTION

Despite the prior art in the area of fractal antennas, there is still a need in the art for further improvement in order to provide an antenna that might include the broad band performance, surface conformability, and reduced aperture and thickness (e.g., suitable for flush mounting with the external surface of a mobile communication device), all the features in a single package.

The present invention partially eliminates disadvantages of the prior art antenna techniques and provides a novel fractal dipole antenna that includes a pair of radiating arms extended from and coupled to a feeding terminal. The radiating arms are oppositely directed along a central antenna's axis. At least a portion of each radiating arm has a fractal geometric shape. At least one pair of electrical shunts are arranged for connecting at least two points selected within the fractal portion of one radiating arm to two points selected within the fractal portion of another radiating arm, correspondingly. It should be understood that the term "within the fractal portion" utilized throughout the present application implies also the fractal portion's edges. For example, the two points can be selected on opposite edges of the fractal portions of each radiating arm relative to the central axis.

According to an embodiment of the present invention, the two radiating arms are cut from a solid sheet of a conductive material. The electrical shunts can be formed of a wire or other self supporting conductive materials.

According to another embodiment of the present invention, the antenna further comprises a substrate made of a nonconductive material. The two radiating arms are formed as a layer of conductive material overlying at least one surface of the substrate. In such a case, the fractal dipole antenna can, for example, be produced by using standard printed circuit techniques. A conducting layer overlying the surface of the substrate can be etched to form a radiating fractal shape of the radiating arms. Alternatively, deposition techniques can be employed to form the fractal conductive layer. Accordingly, the two electrical shunts can be formed as strips of a layer of conductive material arranged on the surface of the substrate.

According to an embodiment of the present invention, the fractal geometric shape of the radiating arms is a Sierpinski gasket. An iteration ratio of self-similarity of the fractal geometric shape can be higher than 2. In such a case, the feeding terminal is arranged at the apex of each triangular Sierpinski gasket portion. In turn, the two points can, for example, be selected at vertices at the base of each triangular Sierpinski gasket portion.

The antenna further includes a balun arranged at the feeding terminal that implies impedance transformation and configured for coupling the radiating arms to a coaxial cable to provide a balanced feed. Preferably, an impedance of the radiating arms is matched to the impedance of the coaxial cable. According to one embodiment of the invention, the balun comprises a first layer of conductive material and a second layer of conductive material arranged on first and second sides of a nonconductive substrate, correspondingly. Each of the layers includes a narrow strip and a wide strip. The narrow and wide strips have proximal and distal ends with respect to the radiating arms. The wide strips are coupled to each other at their proximal ends. Each narrow strip is coupled to a feedpoint of the corresponding radiating arm at its proximal end and to the corresponding wide strip of the same conductive layer via a bridging strip at their distal ends. According to this embodiment of the invention, the narrow strip of the first layer is positioned beneath the wide strip of the second layer and the narrow strip of the second layer is positioned over the wide strip of the first layer.

The antenna of the present invention has many of the advantages of the prior art techniques, while simultaneously overcoming some of the disadvantages normally associated therewith.

The antenna according to the present invention can have one broad band performance in the frequency range in which conventional antennas represent multiple bands performance.

The antenna according to the present invention may be easily and efficiently manufactured, for example, by using printed circuit techniques.

The antenna according to the present invention is of durable and reliable construction.

The antenna according to the present invention may be mounted flush with the surface of a mounting platform.

The antenna according to the present invention may be relatively thin in order to be inset in the skin of a mounting platform without creating a deep cavity therein.

The antenna according to the present invention may be readily conformed to complexly shaped surfaces and contours of a mounting platform. In particular, it can be readily conformable to an airframe or other structures.

The antenna according to the present invention may have a low manufacturing cost.

In summary, according to one broad aspect of the present invention, there is provided a dipole antenna comprising:

a pair of oppositely directed radiating arms coupled to a feeding terminal and extended therefrom along a central axis, at least a portion of each radiating arm having a fractal geometric shape; and at least one pair of electrical shunts configured for connecting at least two points selected within the fractal portion of one radiating arm correspondingly to two points selected within the fractal portion of another radiating arm.

According to another general aspect of the present invention, there is provided an electronic device comprising an antenna that includes:

a pair of oppositely directed radiating arms coupled to a feeding terminal and extended therefrom along a central axis, at least a portion of each radiating arm having a fractal geometric shape; and at least one pair of electrical shunts configured for connecting at least two points selected within the fractal portion of one radiating arm correspondingly to two points selected within the fractal portion of another radiating arm.

The antenna further can comprise a balun arranged at the feeding terminal and configured for coupling said pair of oppositely directed radiating arms to a coaxial cable to provide a balanced feed.

Examples of the electronic device include, but are not limited to, communication devices (e.g., data links, mobile phones, PDAs, remote control units), radars, telemetry stations, jamming stations, etc. The electronic device equipped with the dipole antenna of the present invention can be configured to operate within the frequency range of about 20 MHz to 40 GHz.

According to yet another broad aspect of the present invention, there is provided a method for fabricating a dipole antenna, comprising:

forming a pair of oppositely directed radiating arms coupled to and extended from a feeding terminal along a central axis, at least a portion of each radiating arm having a fractal geometric shape; and forming at least one pair of electrical shunts configured for connecting at least two points selected within the fractal portion of one radiating arm correspondingly to two points selected within the fractal portion of another radiating arm.

The method further can comprise forming a balun arranged at the feeding terminal and configured for coupling said dipole antenna to a coaxial cable to provide a balanced feed.

There has thus been outlined, rather broadly, the more important features of the invention so that the detailed description thereof that follows hereinafter may be better understood, and the present contribution to the art may be better appreciated. Additional details and advantages of the invention will be set forth in the detailed description.

BRIEF DESCRIPTION OF THE DRAWINGS

In order to understand the invention and to see how it may be carried out in practice, preferred embodiments will now be described, by way of non-limiting examples only, with reference to the accompanying drawings, in which.

DETAILED DESCRIPTION OF SPECIFIC EMBODIMENTS

The principles and operation of a dipole antenna according to the present invention may be better understood with reference to the drawings and the accompanying description. It being understood that these drawings are given for illustrative purposes only and are not meant to be limiting.

Figure 1A:
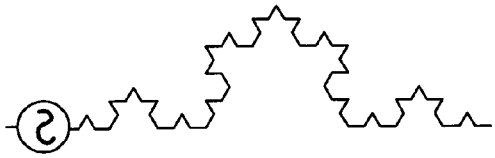
FIGS. 1A to 1D illustrate several typical examples of conventional fractal antennas.
Figure 1B:
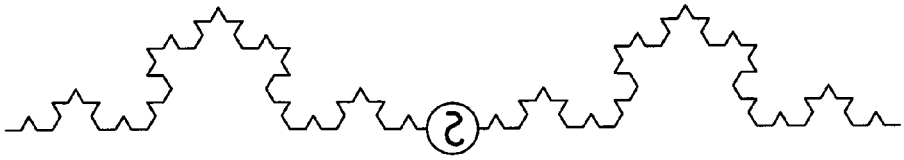
Figure 1C:
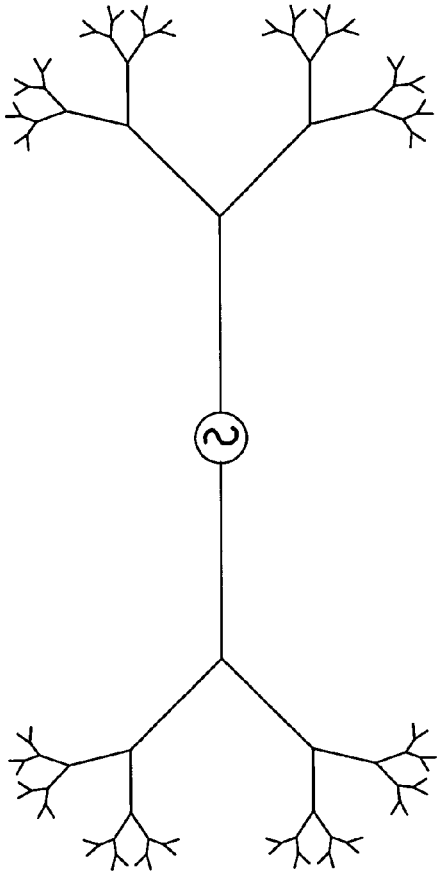
Figure 1D:
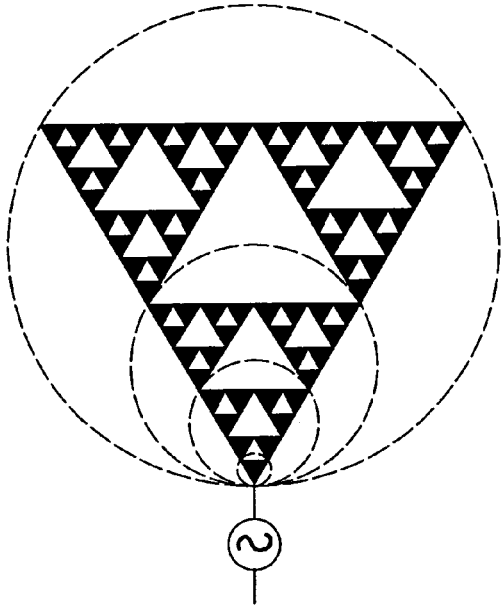
Figure 2:
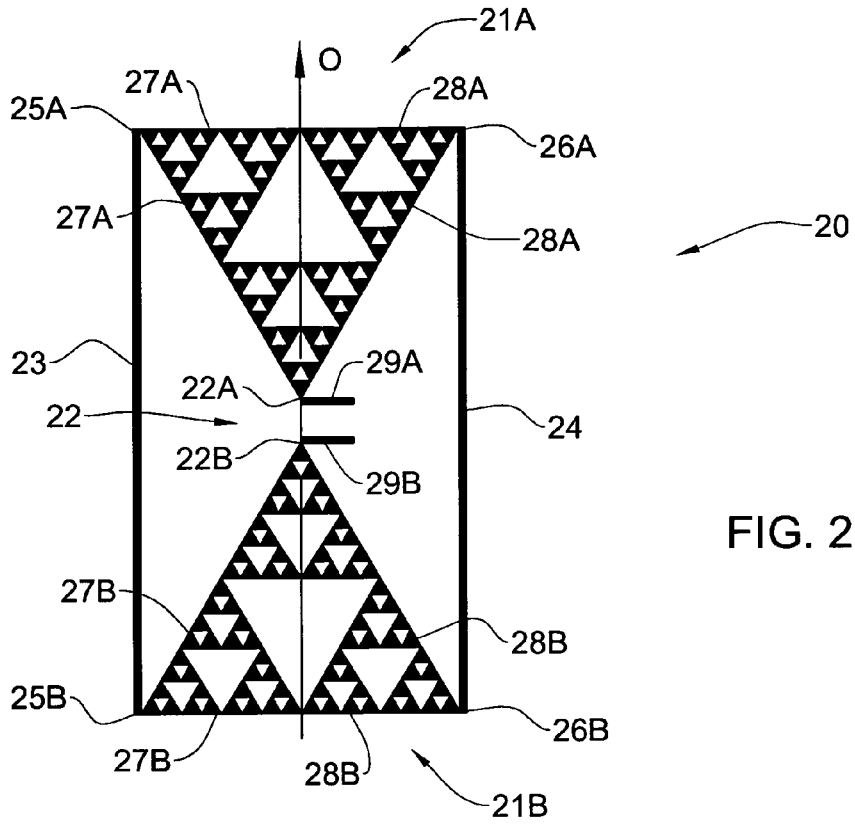
FIG. 2 is a top plan view of an exemplary fractal dipole antenna, according to one embodiment of the present invention.

Referring now to the drawings wherein like reference numerals designate corresponding parts throughout the several views, FIG. 2 illustrate a schematic view of the fractal dipole antenna 20 according to one embodiment of the present invention. It should be noted that this figure as well as further figures (illustrating other examples of the antenna of the present invention) are not to scale, and are not in proportion, for purposes of clarity.

The fractal dipole antenna 20 includes a pair of radiating arms 21A and 21B coupled to feeding terminal 22. The feeding terminal 22 includes a pair of feeding lines 29A and 29B coupled to the radiating arms 21A and 21B, correspondingly.

The radiating arms 21A and 21B extend from the feeding terminal 22 in opposite directions along an axis O. According to this embodiment of the invention, the radiating arms 21A and 21B have a fractal geometric shape. In the general case, at least a portion of each radiating arm must have a fractal geometric shape.

According to this embodiment of the present invention, the fractal geometric shape of the radiating arms 21A and 21B is a Sierpinski gasket. Preferably, but not necessarily, the radiating arms 21A and 21B lie in a common plain.

The feeding lines 29A and 29B are coupled to feeding points 22A and 22B selected at apexes of the largest triangular Sierpinski gaskets corresponding to the radiating arms 21A and 21B, correspondingly. An iteration ratio of self-similarity of the fractal geometric shape can be higher than 2. It should be noted that generally, the fractal geometric shape of the radiating arms is not bound by the Sierpinski gasket shape. Examples of the fractal geometric shape include, but are not limited to, Sierpinski carpet, Minkovski patches, Koch island, etc. When required, a combination of different self-similar patterns can be utilized.

According to one embodiment of the present invention, the largest triangular Sierpinski gasket is in the form of an equilateral triangle.

According to another embodiment of the present invention, the largest triangular Sierpinski gasket is in the form of an isosceles triangle.

The antenna 20 includes a first electrical shunt 23 and a second electrical shunt 24, which are arranged at opposite sides with respect to axis O. Generally, the first and second electrical shunts are configured for connecting two opposite points 25A and 26A selected within the radiating arm 21A to two opposite points 25B and 26B selected within the radiating arm 21B, correspondingly.

According to the example illustrated in FIG. 2, the points 25A and 26A are selected at vertices at the base of the largest triangular Sierpinski gasket of the radiating arm 21A, while the points 25B and 26B are selected at vertices at the base of the largest triangular Sierpinski gasket of the radiating arm 21B. As can be seen, the points 25A and 26A as well as the points 25B and 26B are symmetric with respect to the axis O.

It should be noted that the invention is not bound by this location of the points 25A and 26A. When required, the electrical shunt 23 can connect any point selected upon a verge 27A of the radiating arm 21A to any point selected upon the corresponding verge 27B of the radiating arm 21B at one side with respect to the axis O. Accordingly, the electrical shunt 24 (that is arranged at the opposite side with respect to the axis O) can connect any point selected upon a verge 28A of the radiating arm 21A to any corresponding point selected upon a verge 28B of the radiating arm 21B.

Figure 3:
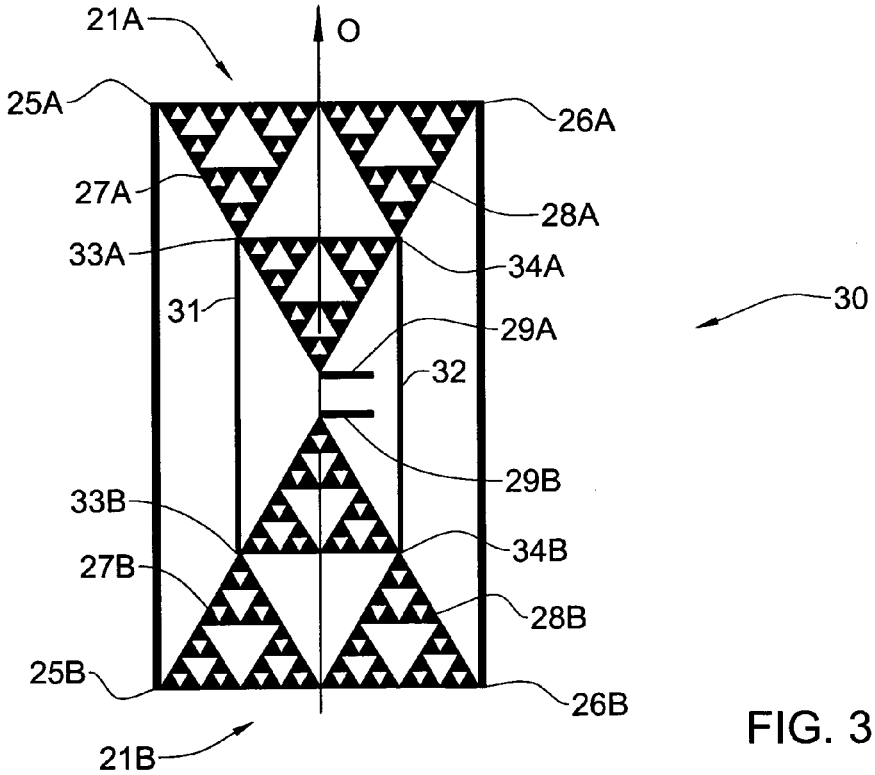
FIG. 3 is a top plan view of an exemplary fractal dipole antenna, according to another embodiment of the present invention

It should also be noted that when required more than one pair of electrical shunts can be used for coupling the radiating arms 21A and 21B. For example, two or more electrical shunts can be arranged at each side of the arms with respect to axis O to connect four or more (even number) of points selected within the radiating arm 21A to the corresponding number of points selected within the radiating arm 21B. FIG. 3 shows an example of a fractal dipole antenna 30 in which the radiating arms 21A and 21B are connected by two pairs of electrical shunts. In this case, a first pair of shunts 23 and 24 connects the vertices at the base of the largest triangular Sierpinski gaskets of the radiating arms 21A and 21B, i.e., similar to the connection shown in FIG. 2. Accordingly, a second pair of shunts 31 and 32 connects points 33A and 34A selected upon verges 27A and 28A of the arm 21A to points 33B and 34B selected upon verges 27B and 28B of the arm 21B.

The antenna of the present invention may be fed using any conventional manner, and in a manner compatible with the corresponding external electronic unit (source or receiver) for which the antenna is employed. For example, an external unit (not shown) can be connected to the radiating arms 21A and 21B by providing a connector (not shown) at the end of the pair of the feeding lines 29A and 29B, and fastening a coaxial cable or any other transmission line (not shown) between this connection and the external unit.

As will be shown hereinbelow, an external unit may also be connected to the radiating arms via a balun.

It can be understood that a variety of manufacturing techniques can be employed to manufacture the illustrated antenna structure. For example, the pair of radiating arms 21A and 21B can be cut from a solid sheet of a conductive material. The first and second electrical shunts 23 and 24 as well as the pair of the feeding lines 29A and 29B can be formed of a wire or other self supporting conductive materials.

According to another example, the antenna can be built on a substrate made of a nonconductive material. Examples of the nonconductive material include, but are not limited to, Teflon (e.g., Duroid provided by Rogers Cie), Epoxy (e.g., FR4), etc. This is an important feature of the design, because it enables the antenna as a whole to be very thin. Thus, when required, the thin antenna of this example of the present invention may be mounted flush with the surface of the mounting platform (e.g., a communicating device) or may be inset in the outer skin of the mounting platform.

Figure 7A:
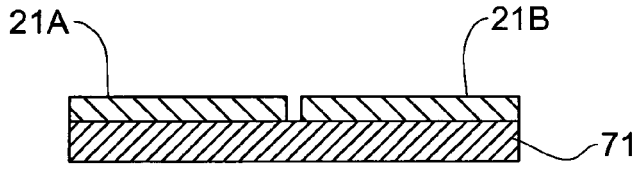
FIG. 7A is a schematic sideview of the antenna, according to one embodiment of the present invention.

Referring to FIG. 7A, a schematic sideview of the antenna 20 built on a substrate 71 is illustrated, according to an embodiment of the present invention. According to this embodiment, the pair of radiating arms 21A and 21B is formed as a layer of conductive material overlying one surface of the substrate 71.

Figure 7B:
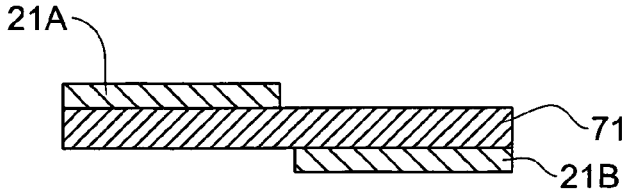
FIG. 7B is a schematic sideview of the antenna, according to another embodiment of the present invention.

FIG. 7B shows a schematic sideview of the antenna 20 built on a substrate 71, according to another embodiment of the present invention. According to this embodiment, the radiating arm 21A is formed as a layer of conductive material overlying one surface of the substrate 71, while the radiating arm 21B is formed as a layer of conductive material overlying another surface of the substrate 71.

The dipole antenna shown in FIG. 7A and in FIG. 7B can be produced by using any standard printed circuit techniques. A conducting layer overlying the surfaces of the substrate can, for example, be etched to form a radiating fractal shape of the radiating arms. Alternatively, deposition techniques can be employed to form the fractal conductive layer. In these cases, the first and second electrical shunts 23 and 24 as well as the pair of the feeding lines 29A and 29B can be formed as strips of a layer of conductive material arranged on the surfaces of the substrate 71.

Figure 7C:
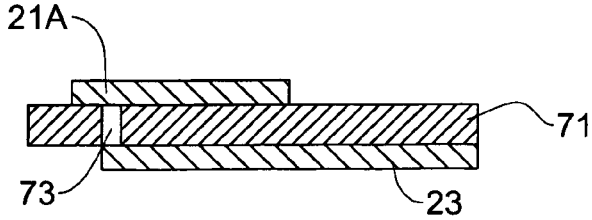
FIG. 7C shows an example of coupling conductive layers formed on different sides of a substrate.

It should be understood that when the radiating arms 21A and 21B are formed on different sides of the substrate 71, vias can be used for connecting the conductive layers arranged on different sides of the substrate 71. FIG. 7C shows an example of how the radiating arm 21A formed on one side of the substrate 71 can be connected to the shunts 23 arranged on the other side of the substrate 71 by using a via 72. The vias can, for example, be in the form of empty bores drilled through the substrate 71 and having a conductive cover on the internal surface of the bores. According to another example, the bores may be filled with a conductive material, e.g. with metal pins.

Figure 4A:
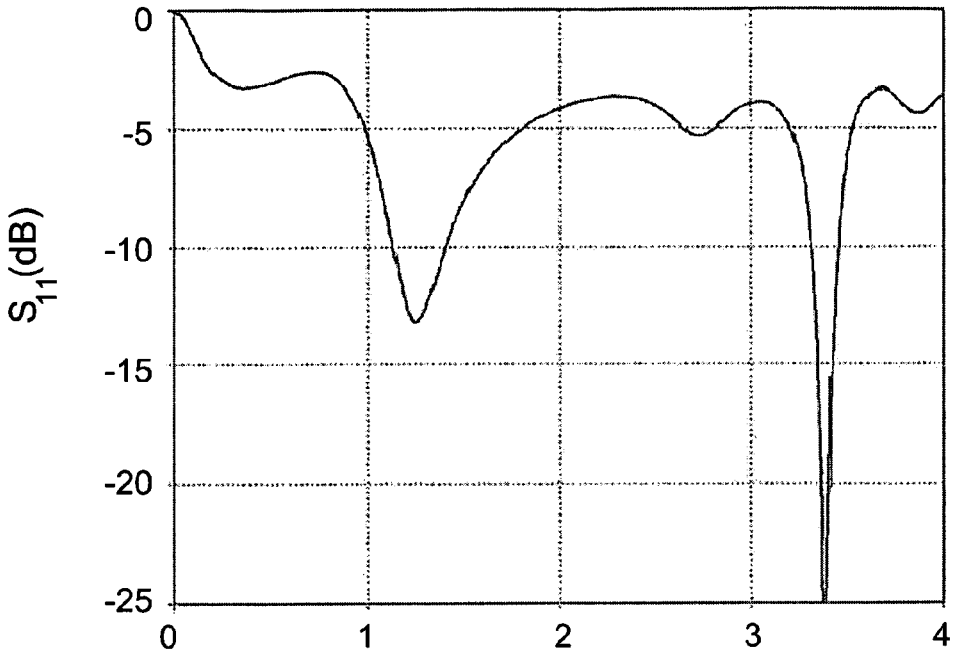
FIGS. 4A, 4B and 4C illustrate exemplary graphs depicting the frequency dependence of the input reflection (return loss) coefficient for antennas having various configurations.
Figure 4B:
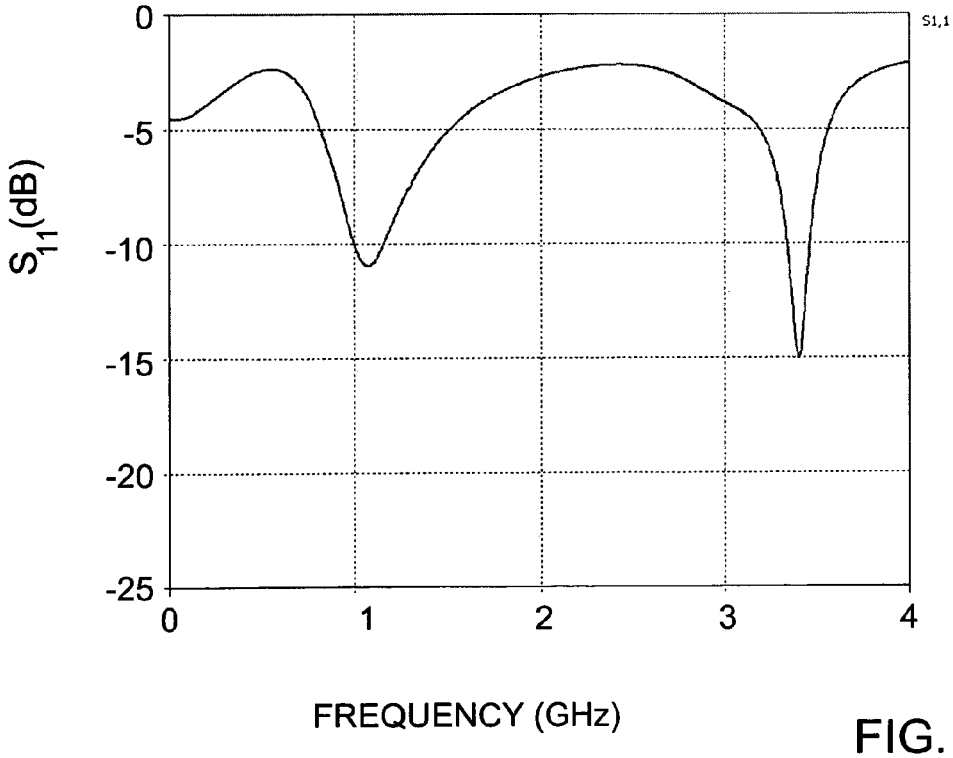

Referring to FIGS. 4A and 4B, exemplary graphs depicting the frequency dependence of the input reflection (return loss) coefficient ($S_{11}$) of the antenna shown in FIG. 2 and the frequency dependence of $S_{11}$ for a similar antenna which does not include shunts 23 and 24 are illustrated, respectively. These graphs were obtained by simulation of the properties of the antennas printed on substrate having a thickness of 1.6 mm and a value of the dielectric permittivity of 2.2 that corresponds to Teflon (e.g., Duroid). The largest triangular Sierpinski gasket was selected in the form of an isosceles triangle, in which dimension of the base and sides are 9 cm and 6 cm, respectively. As can be seen, adding two shunts 23 and 24 to a conventional dipole fractal antenna can modify the frequency/return loss characteristic. In particular, the low frequency band slightly shifts to higher frequencies, while the high frequency band remains almost at the same place. In turn, the return losses for these both bands remain below −10 dB, while largely decrease for the high frequency band.

Figure 5A:
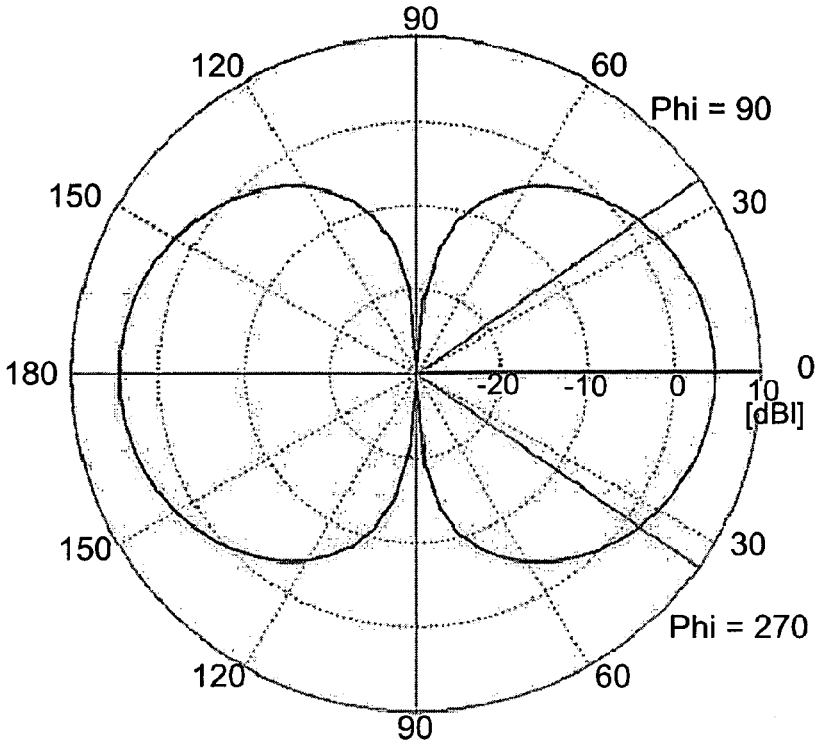
FIGS. 5A, 5B and 5C illustrate examples of a front to back cut of radiation pattern in electric field plane (E-plane) for antennas having various configurations.
Figure 5B:
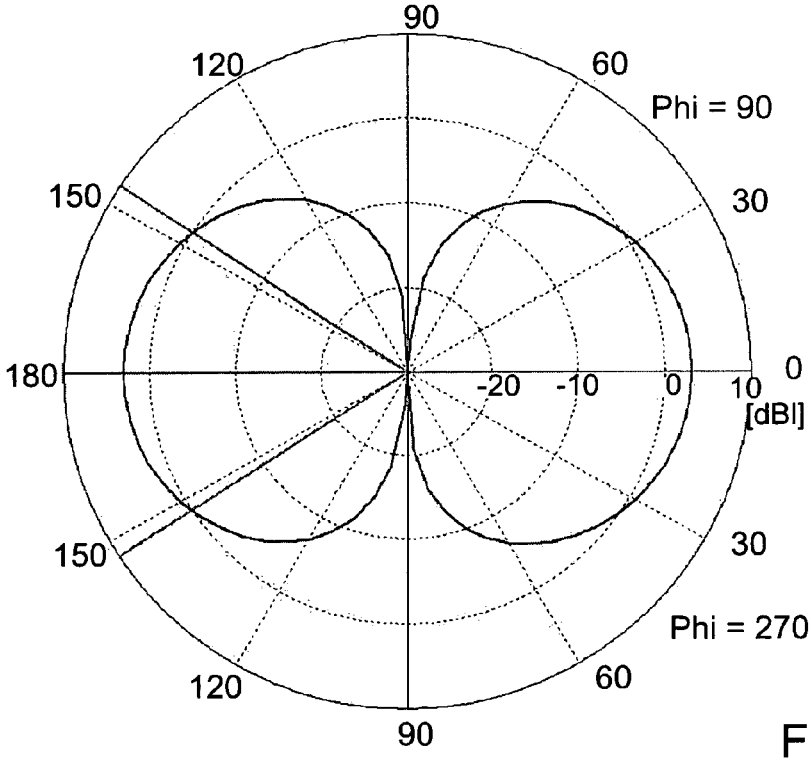
Figure 6A:
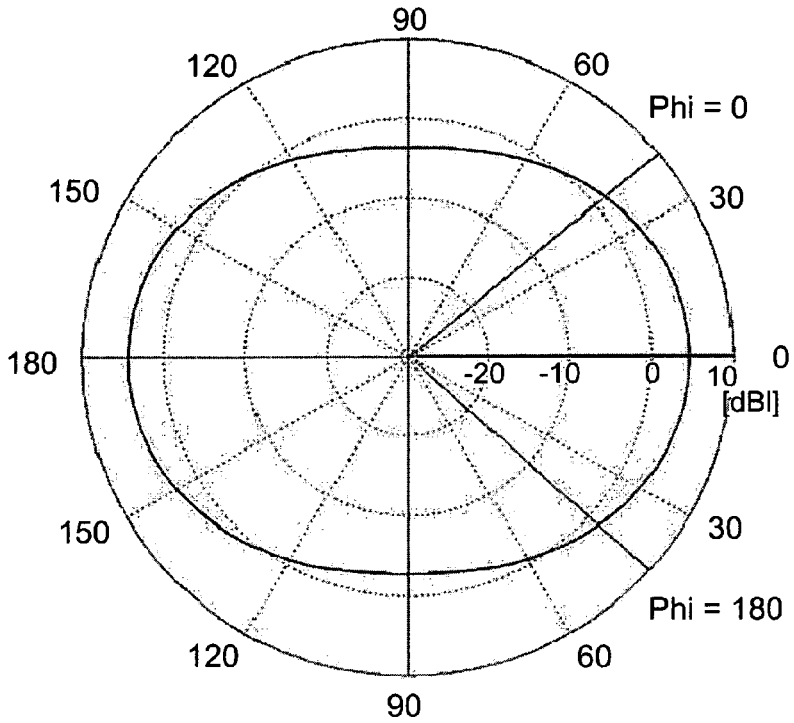
FIGS. 6A, 6B and 6C illustrate examples of a front to back cut of radiation pattern in magnetic field plane (H-plane) for antennas having various configurations.
Figure 6B:
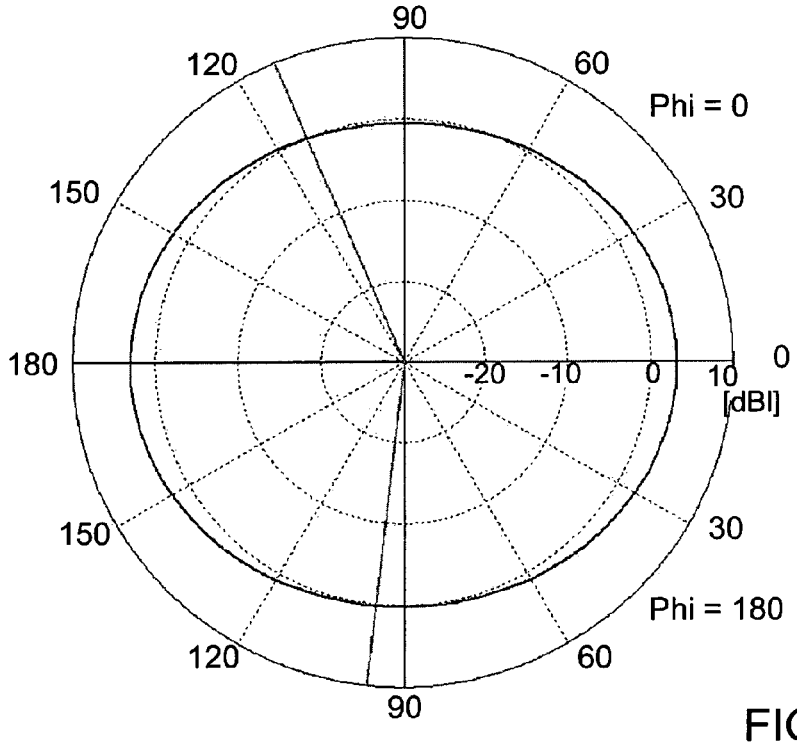

FIGS. 5A and 5B illustrate examples of a front to back cut of radiation pattern in electric field plane (E-plane) for the antenna shown in FIG. 2 and the pattern for a similar antenna which does not include shunts 23 and 24, respectively. Accordingly, FIGS. 6A and 6B illustrate examples of a front to back cut of radiation pattern in magnetic field plane (H-plane) for the antenna shown in FIG. 2 and the pattern for a similar antenna which does not include shunts 23 and 24, respectively. As can be seen, adding two shunts 23 and 24 to a conventional dipole fractal antenna does not change significantly the radiation behavior of the antenna.

Figure 8A:
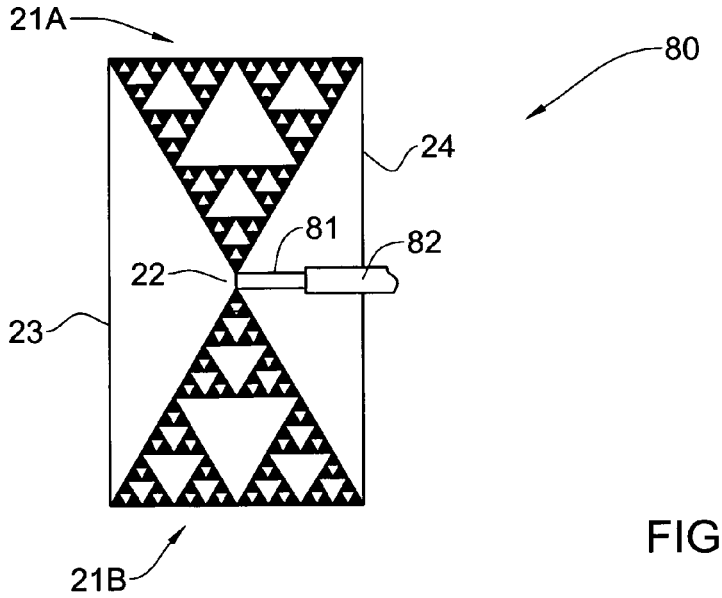
FIG. 8A is a top plan view of an exemplary fractal dipole antenna, according to still another embodiment of the present invention.

Referring to FIG. 8A, a top plan view of the antenna 80 is illustrated, according to a further embodiment of the invention. The antenna 80 includes a balun 81 arranged at the feeding terminal 22 and configured for coupling the pair of the radiating arms 21A and 21B to a coaxial cable 82 to provide a balanced feed.

A description of the balun 81 in accordance with an embodiment of the present invention will be shown hereinbelow with reference to FIGS. 8B and 8C together, which illustrate a top view with separated radiating arms and a perspective exploded view of an exemplary fractal dipole antenna, correspondingly. According to this embodiment, the radiating arms 21A and 21B are formed on different sides of a nonconductive substrate (not shown in FIGS. 8B and 8C, for purposes of clarity).

Preferably, but not mandatory, that the balun and the radiating arms are all formed on the same substrate. The balun 81 includes a first layer 82A of conductive material formed on one side of the substrate and a second layer 82B of conductive material formed on the other side of the substrate. The first and second conductive layers have a shape in the form of two parallel strips, such as narrow strips 83A and 83B and wide strips 84A and 84B, respectively. The narrow strips 83A, 83B have proximal ends 831A, 831B and distal ends 832A, 832B, respectively. In turn, the wide strips 84A, 84B have proximal ends 841A, 841B and distal ends 842A, 842B, respectively.

The balun 81 is connected to the feeding points 22A of the radiating arms 21A at the proximal ends 831A of the narrow strip 83A. Likewise, the balun 81 is connected to the feeding points 22B of the radiating arms 21B at the proximal ends 831B of the narrow strip 83B.

The wide strips 84A and 84B are coupled to each other at their proximal ends 841A, 841B, for example by using a via 86. The via 86 can be in the form of a bore drilled through the substrate and filled with an electrical conductive material.

The narrow strip 83A and the wide strips 84A are coupled to each other at their distal ends 832A and 842A by means of a bridging strip 85A. Likewise, the narrow strip 83B and the wide strips 84B are coupled to each other at their distal ends 832B and 842B by means of a bridging strip 85B.

Preferably, but not mandatory, that the width of the narrow strips 83A and 83B be at least two times narrower than the width of the wide strips 84A and 84B. The width of the bridging strips 85A and 85B is such that these strips could hold a connector (not shown) provided for coupling the antenna 80 to a coaxial cable (not shown).

According to this embodiment, the first and second conductive layers are printed on the substrate in such a manner so that the narrow strip 83A of the first layer 82A is positioned beneath the wide strip 84B of the second layer 82B. In turn, the narrow strip 83B of the second layer 82B is positioned over the wide strip 84A of the first layer 82A.

In such a configuration, the wide strip 84B of the second layer 82B acts as a ground plane for the narrow strip 83A of the first layer 82A, and vice versa the wide strip 84A of the first layer 82A acts as a ground plane for the narrow strip 83B of the second layer 82B.

In order to accomplish maximum energy transfer in broadband operation, an impedance of the radiating arms 21A and 21B is matched to the impedance of the coaxial cable. To achieve this impedance match, the width of the narrow and wide strips can be adjusted to required values.

Figure 4C:
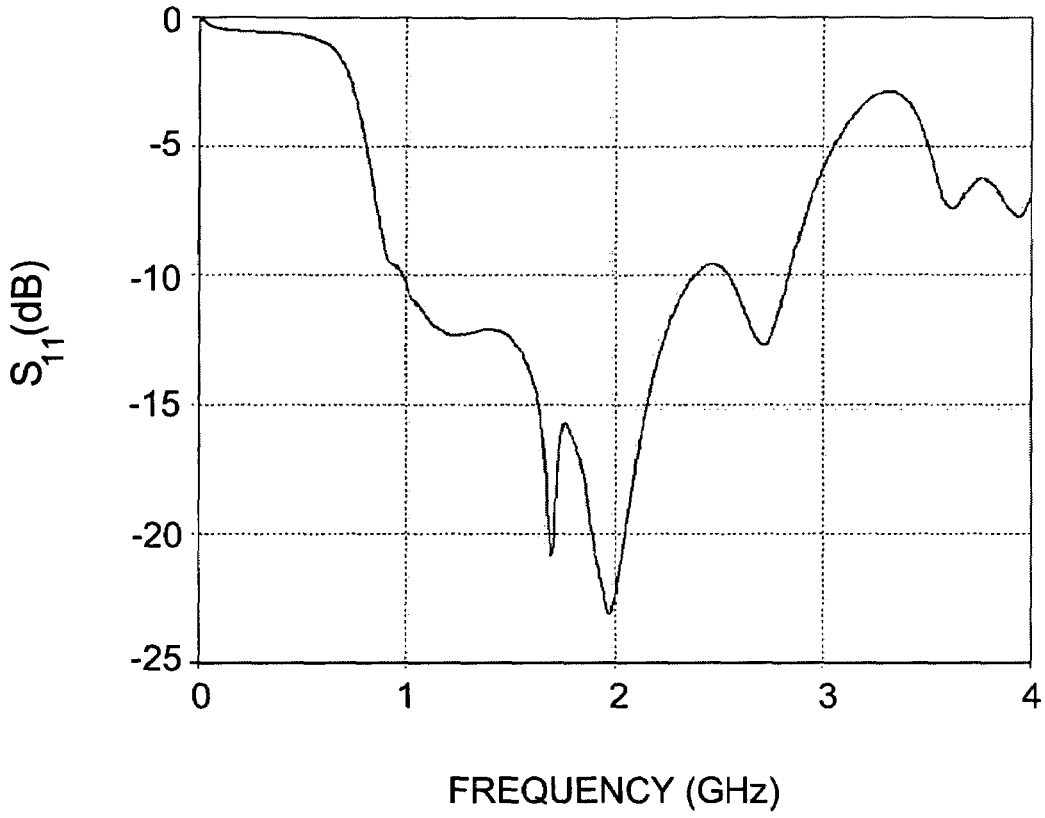
Figure 8B:
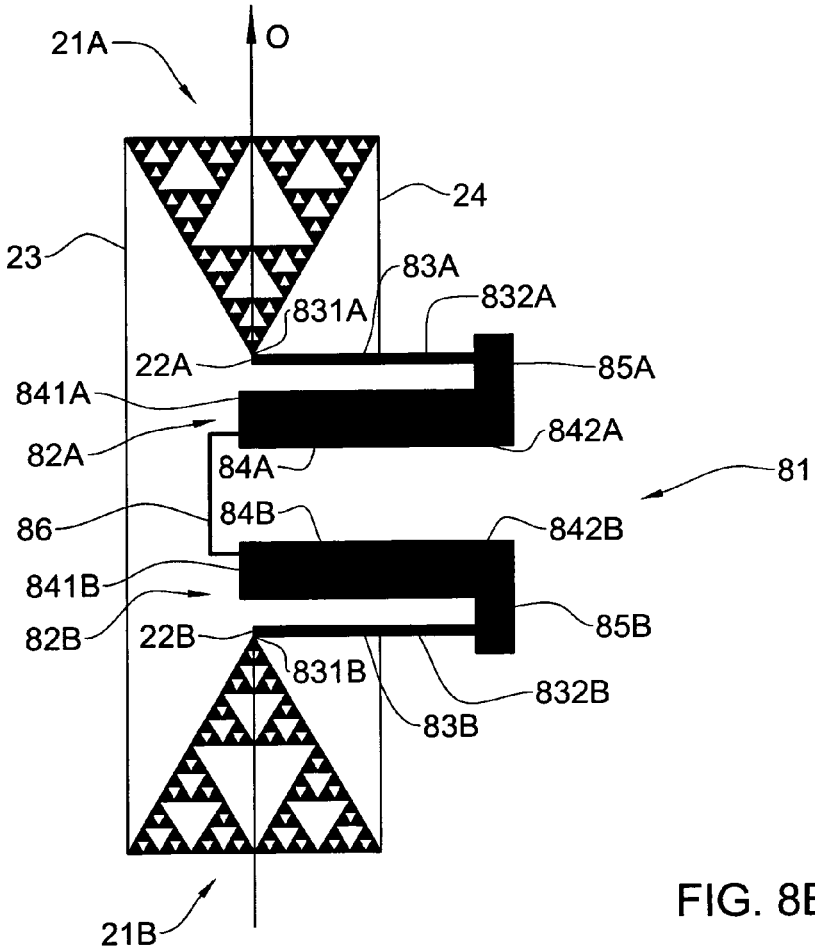
FIGS. 8B and 8C illustrate a schematic top view with separated radiating arms and a perspective exploded view, correspondingly, of an exemplary fractal dipole antenna according to yet another embodiment of the present invention.
Figure 8C:
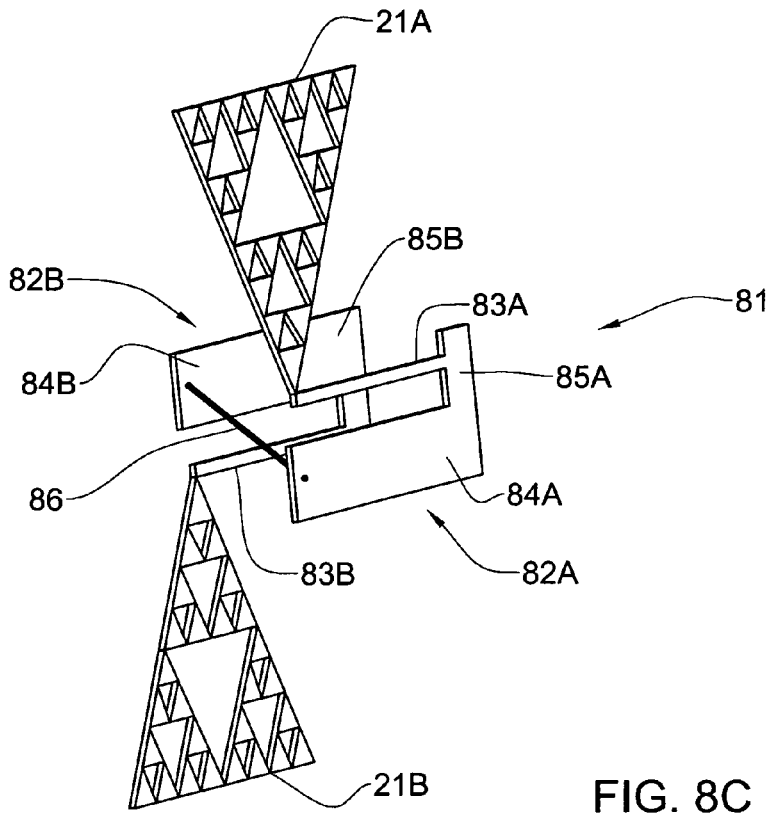

Referring to FIG. 4C, an exemplary graph depicting the frequency dependence of the input reflection (return loss) coefficient ($S_{11}$) of the antenna shown in FIGS. 8B and 8C is illustrated. When this dependence is compared to the corresponding curves shown in FIGS. 4A and 4B, one can see that adding two shunts 23 and 24 together with the balun to the conventional dipole fractal antenna significantly modifies the return loss characteristic. In such a case, one broad frequency band is observed in the frequency region 1–3 GHz where two bands were monitored for the conventional fractal antenna and for the fractal antenna with two shunts.

Figure 5C:
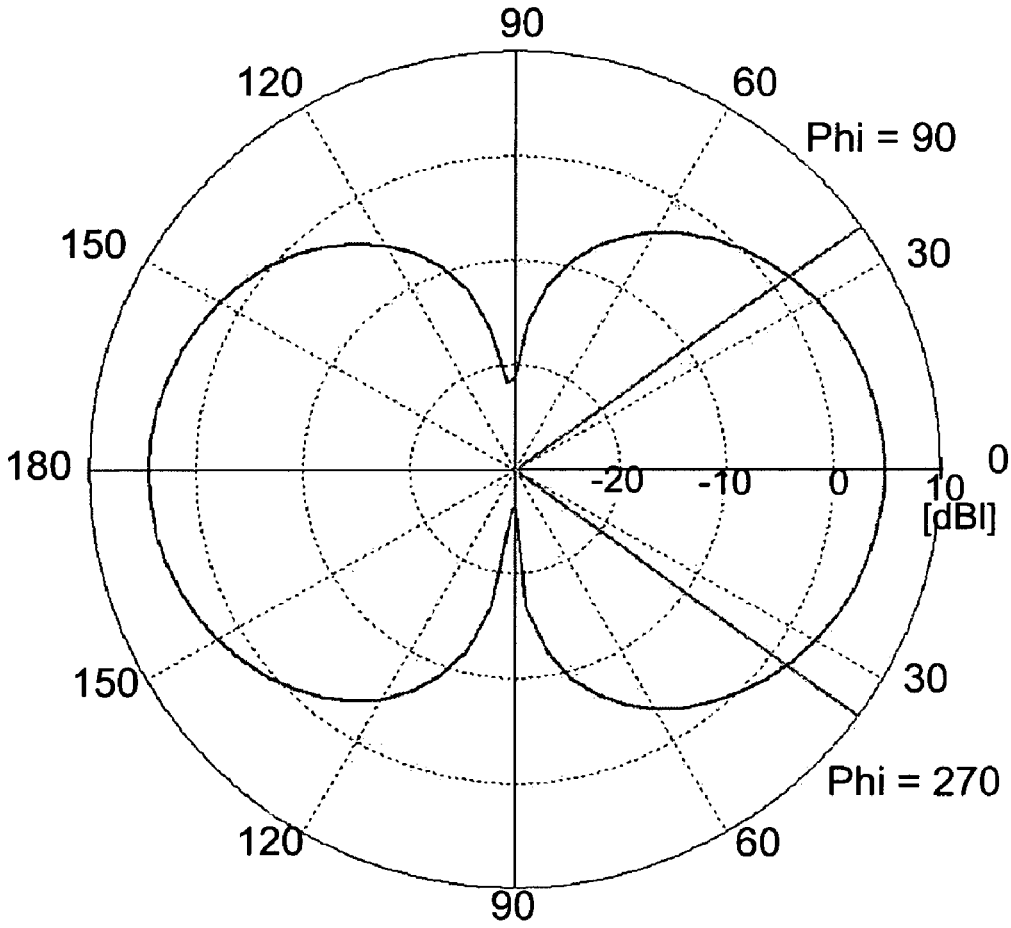
Figure 6C:
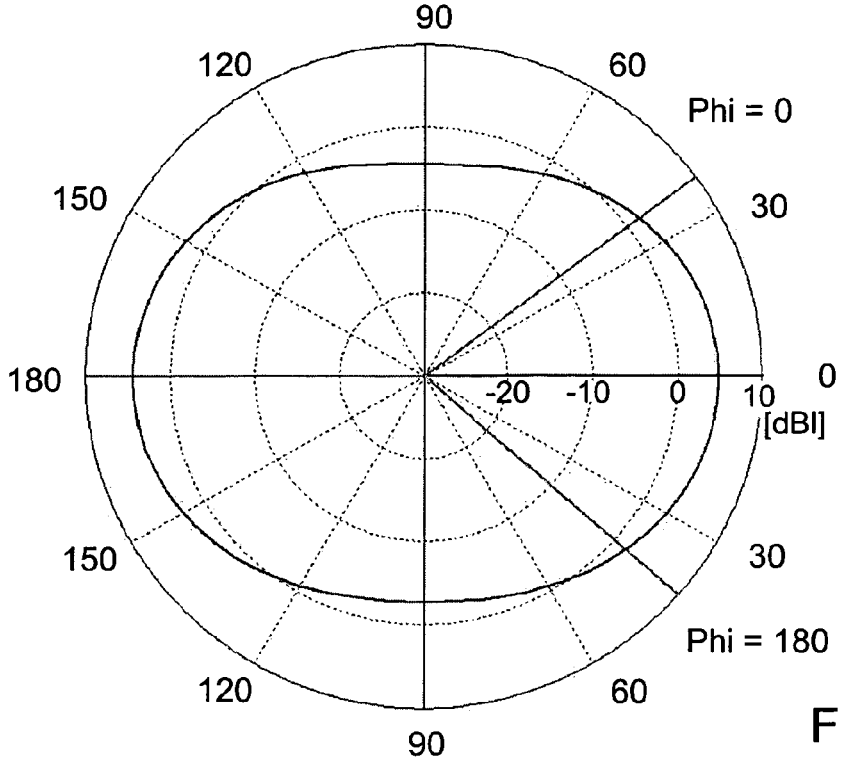

FIGS. 5C and 6C illustrate a front to back cut of radiation pattern in E-plane and in H-plane, correspondingly, for the antenna shown in FIGS. 8B and 8C. As can be seen, adding two shunts 23 and 24 and balun 81 to a conventional dipole fractal antenna does not change significantly the radiation behavior of the conventional antenna.

Figure 9:
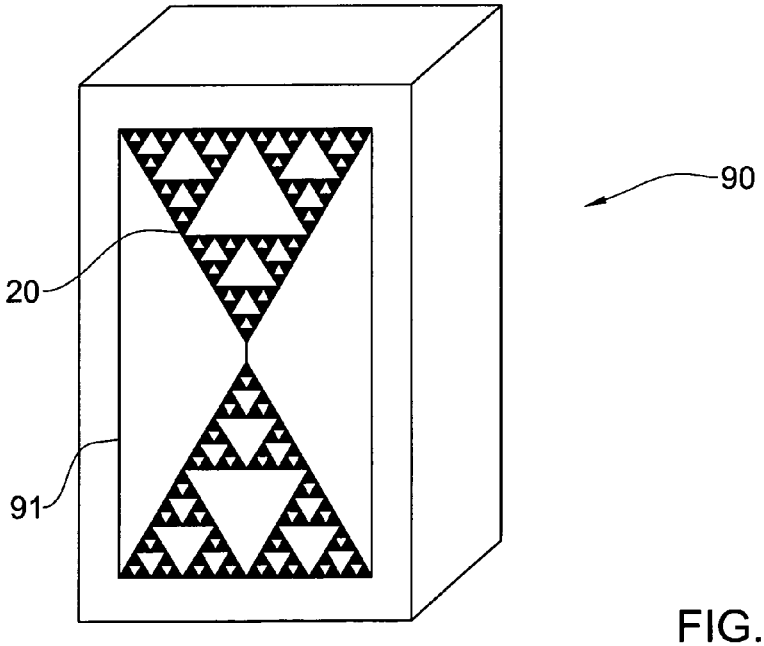
FIG. 9 is a schematic view of an electronic device including an antenna of the present invention.

Referring to FIG. 9, a schematic view of an electronic device 90 including the antenna 20 of the present invention is illustrated. According to this embodiment of the present invention, the antenna 20 is mounted on a back surface 91 of the device 90.

It can be appreciated by a person of the art that the dipole antenna of the present invention may have numerous applications. The list of applications includes, but is not limited to, various devices operating in the frequency band of about 20 MHz to 40 GHz. In particular, the antenna of the present invention would be operative with communication devices (e.g., mobile phones, PDAs, remote control units, telecommunication with satellites, etc.), radars, telemetry stations, jamming stations, etc.

As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

It is apparent that the antenna of the present invention is not bound to the examples of the symmetric and planar antennas. If necessary, the form and shape of the antenna may be defined by the form and shape of the mounting platform. Likewise, the when required, the radiating arms can have a volume (three-dimensional) fractal geometric shape.

It should be noted that the single element antenna described above with references to FIGS. 2, 3 and 8A–8C, can be implemented in an array structure of a regular or fractal form, taking the characteristics of the corresponding array factor. Furthermore, when required, this array antenna can be monolithically co-integrated on-a-chip together with other elements (e.g. DSP-driven switches) and can also radiate steerable multibeams, thus making the whole array a smart antenna.

In order to limit the radiation to one direction, a ground plane known per se may be provided for the antenna of the present invention. For example, the ground plane may be arranged in a parallel manner to a plane of the antenna and face one of the sides of the substrate on which the antenna is printed. Such implementation of the antenna can increase the radiation directivity of the antenna. Moreover, it can eliminate the drawback of many conventional mobile phone antennas, since the radiation directed towards the mobile phone user will be significantly decreased, when compared with the bi-directional radiation of the most conventional mobile phone devices.

Additionally, the antenna of the present invention may allow reducing the development effort required for connectivity between different communication devices associated with different communication services and operating in various frequency bands. For example, the antenna of the present invention may allow utilizing a single cellular phone for communicating over different cellular services.

The antenna of the present invention may be utilized in Internet phones, tag systems, remote control units, video wireless phone, communications between Internet and cellular phones, etc. The antenna may also be utilized in various intersystems, e.g., in communication within the computer wireless LAN (Local Area Network), PCN (Personal Communication Network) and ISM (Industrial, Scientific, Medical Network) systems.

The antenna may also be utilized in communications between the LAN and cellular phone network, GPS (Global Positioning System) or GSM (Global System for Mobile communication).

It is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims.

The invention claimed is:

1. A dipole antenna comprising:

a pair of oppositely directed radiating arms coupled to a feeding terminal and extended therefrom along a central axis, at least a portion of each radiating arm having a fractal geometric shape; and at least one pair of electrical shunts configured for connecting at least two points selected within the fractal portion of one radiating arm correspondingly to two points selected within the fractal portion of another radiating arm.

2. The dipole antenna of claim 1 configured and operable to provide decrease of return losses for the frequency bands provided for another antenna having the same structure as said antenna, but without said at least one pair of electrical shunts.

3. The dipole antenna of claim 1 further comprising a balun arranged at the feeding terminal and configured for coupling said pair of oppositely directed radiating arms to a coaxial cable to provide a balanced feed.

4. The dipole antenna of claim 3 configured and operable to provide one broad frequency band in the frequency band where a plurality of the frequency bands is observed for another antenna having the same structure as said antenna, but without said balun.

5. The dipole antenna of claim 3 wherein an impedance of said radiating arms is matched to the impedance of the coaxial cable.

6. The dipole antenna of claim 3 wherein said balun comprises a first layer of conductive material and a second layer of conductive material arranged on first and second sides of a nonconductive substrate, correspondingly; each of said first and second layers includes a narrow strip and a wide strip, said narrow and wide strips have proximal and distal ends with respect to the radiating arms, each narrow strip is coupled to a feedpoint of the corresponding radiating arm at its proximal end and to the corresponding wide strip of the same conductive layer via a bridging strip at their distal ends; said narrow strip of the first layer is positioned beneath the wide strip of the second layer and said narrow strip of the second layer is positioned over the wide strip of the first layer.

7. The dipole antenna of claim 1 wherein said at least two points are selected on opposite edges of the fractal portions of each radiating arm relative to the central axis.

8. The dipole antenna of claim 1 further comprising a substrate made of a nonconductive material, wherein said two radiating arms are formed as a layer of conductive material overlying a surface of said substrate.

9. The dipole antenna of claim 8 wherein said two radiating arms are arranged on one side of said substrate.

10. The dipole antenna of claim 8 wherein one radiating arm of said two radiating arms is arranged on one side of said substrate and another radiating arm of said two radiating arms is arranged on another side of said substrate.

11. The dipole antenna of claim 1 wherein said fractal geometric shape is a Sierpinski gasket.

12. The dipole antenna of claim 11 wherein said feeding terminal is coupled to the apex of each triangular Sierpinski gasket portion.

13. The dipole antenna of claim 11 wherein said at least two points are selected at vertices at the base of each triangular Sierpinski gasket portion.

14. The dipole antenna of claim 11 wherein an iteration ratio of self-similarity of said fractal geometric shape is higher than 2.

15. An electronic device comprising the antenna of claim 1.

16. The electronic device of claim 15 further comprising a balun arranged at the feeding terminal and configured for coupling said pair of oppositely directed radiating arms to a coaxial cable to provide a balanced feed.

17. The electronic device of claim 15 being selected from the group that includes communication devices, jamming stations, radars, and telemetry systems.

18. The electronic device of claim 15 wherein said dipole antenna being configured to operate within the frequency range of about 20 MHz to 40 GHz.

19. A dipole antenna comprising:

a pair of oppositely directed radiating arms coupled to a feeding terminal and extended therefrom along a central axis, at least a portion of each radiating arm having a fractal geometric shape;

at least one pair of electrical shunts configured for connecting at least two points selected within the fractal portion of one radiating arm correspondingly to two points selected within the fractal portion of another radiating arm; and a balun arranged at the feeding terminal and configured for coupling said pair of oppositely directed radiating arms to a coaxial cable to provide a balanced feed.

20. A method of fabricating a dipole antenna comprising:

forming a pair of oppositely directed radiating arms coupled to and extended from a feeding terminal along a central axis, at least a portion of each radiating arm having a fractal geometric shape; and forming at least one pair of electrical shunts configured for connecting at least two points selected within the fractal portion of one radiating arm correspondingly to two points selected within the fractal portion of another radiating arm.

21. The method of claim 20 further comprising forming a balun arranged at the feeding terminal and configured for coupling said dipole antenna to a coaxial cable to provide a balanced feed.

22. The method of claim 21 wherein said forming of the balun comprises:

providing a nonconductive substrate of a predetermined form;

providing a first layer of conductive material and a second layer of conductive material on first and second sides of said nonconductive substrate, correspondingly; each of said first and second layers includes a narrow strip and a wide strip, said narrow and wide strips have proximal and distal ends with respect to the radiating arms, each narrow strip is coupled to a feedpoint of the corresponding radiating arm at its proximal end and to the corresponding wide strip of the same conductive layer via a bridging strip at their distal ends; said wide strips are coupled to each other at their proximal ends; said narrow strip of the first layer is positioned beneath the wide strip of the second layer and said narrow strip of the second layer is positioned over the wide strip of the first layer.

23. The method of claim 20 wherein said forming of the pair of radiating arms includes cutting the radiating arms from a solid sheet of conductive material.

24. The method of claim 20 further comprising providing a nonconductive substrate of a predetermined form, and wherein the pair of radiating arms is formed as a layer of electrically conductive material overlaying a surface of said nonconductive substrate.

25. The method of claim 20 wherein said forming of the two electrical shunts includes forming strips of electrically conductive material on the surface of said nonconductive substrate for connecting said at least two points.

* * * * *